US012330842B2

(12) United States Patent
Hanan

(10) Patent No.: US 12,330,842 B2
(45) Date of Patent: Jun. 17, 2025

(54) TAMPER EVIDENCE CONTAINER CLOSURE

(71) Applicant: NIAGARA BOTTLING, LLC, Diamond Bar, IL (US)

(72) Inventor: Jay Clarke Hanan, Glendora, IL (US)

(73) Assignee: Niagara Bottling, LLC, Diamond Bar, CA (US)

( * ) Notice: Subject to any disclaimer, the term of this patent is extended or adjusted under 35 U.S.C. 154(b) by 0 days.

(21) Appl. No.: 18/376,075

(22) Filed: Oct. 3, 2023

(65) Prior Publication Data

US 2024/0101314 A1 Mar. 28, 2024

Related U.S. Application Data

(63) Continuation of application No. 17/567,691, filed on Jan. 3, 2022, now Pat. No. 11,866,232, which is a (Continued)

(51) Int. Cl.

| | |
|---|---|
| ***B65D 41/34*** | (2006.01) |
| ***B65D 41/32*** | (2006.01) |
| ***B65D 41/38*** | (2006.01) |

(52) U.S. Cl.

CPC ..... *B65D 41/3423* (2013.01); *B65D 41/325* (2013.01); *B65D 41/38* (2013.01); *B65D 2251/023* (2013.01); *B65D 2401/15* (2020.05)

(58) Field of Classification Search

CPC ..... B65D 41/3447; B65D 1/0284; B65D 41/3495; B65D 1/0246; B65D 2101/00; (Continued)

(56) References Cited

U.S. PATENT DOCUMENTS

| | | | |
|---|---|---|---|
| 2,947,432 | A | 8/1960 | Marcel |
| 3,032,809 | A | 5/1962 | Willard |

(Continued)

FOREIGN PATENT DOCUMENTS

| | | | |
|---|---|---|---|
| CN | 101234688 | A | 8/2008 |
| CN | 106542191 | A | 3/2017 |

(Continued)

OTHER PUBLICATIONS

International Search Report with Written Opinion, PCT Application No. PCT/US2019/044175, mailed Oct. 15, 2019.

(Continued)

*Primary Examiner* — Kareen K Thomas

(74) *Attorney, Agent, or Firm* — Michael Best & Friedrich LLP

(57) ABSTRACT

A container closure and methods are disclosed for providing visible evidence of removal of the closure from a container after installation by a manufacturer. The closure includes tamper evidence bridges comprising small tabs of material that extend from a bottom-most edge of the closure to a tamper evidence ledge of the container. The bridges break when the closure is rotated relative to the tamper evidence ledge, thereby providing readily visible evidence that the closure has been removed after installation by the manufacturer. In some embodiments, a tamper evidence closure engages with threads of a finish of the container. Cam locks around the perimeter of the tamper evidence closure are permanently flared by cams on the finish during loosening of the closure. Outward flaring of the cam locks provides a visual indication that the tamper evidence closure has been loosened after installation by a manufacturer.

4 Claims, 11 Drawing Sheets

Related U.S. Application Data continuation of application No. 16/520,165, filed on Jul. 23, 2019, now Pat. No. 11,214,410, which is a continuation of application No. 15/423,383, filed on Feb. 2, 2017, now Pat. No. 10,377,534.

(60) Provisional application No. 62/724,538, filed on Aug. 29, 2018, provisional application No. 62/712,138, filed on Jul. 30, 2018, provisional application No. 62/290,434, filed on Feb. 2, 2016.

(58) Field of Classification Search

CPC ..... B65D 41/3409; B65D 41/3404; B65D 55/024; B65D 2401/20; B65D 88/64; B65D 2588/64; B65D 43/0235; B65D 83/7575; B65D 33/2585; B65D 41/3419; B65D 41/3438; B65D 41/3457; B65D 41/3461; B65D 41/0464; B65D 41/0457; B65D 83/0027

See application file for complete search history.

(56) References Cited

U.S. PATENT DOCUMENTS 3,335,889 A 8/1967 Brumme
3,438,578 A 4/1969 Peterson et al.
3,684,118 A 8/1972 Brumme
3,746,201 A 7/1973 Fujio
3,769,394 A 10/1973 Latrielle
3,773,205 A 11/1973 Keller et al.
3,809,365 A 5/1974 Loffler
3,850,328 A 11/1974 Guala
3,850,329 A 11/1974 Robinson
3,901,403 A 8/1975 Menke
4,197,955 A 4/1980 Luenser
4,316,551 A 2/1982 Belokin, Jr.
4,374,878 A 2/1983 Jakobsen et al.
4,436,212 A 3/1984 Alejandro Llera
4,567,991 A 2/1986 Anderson
4,579,241 A 4/1986 Hayes
4,674,643 A 6/1987 Wilde et al.
4,744,478 A 5/1988 Hahn
4,744,479 A 5/1988 Schottli
4,744,480 A 5/1988 Luch et al.
4,818,575 A 4/1989 Hirata et al.
4,895,265 A 1/1990 Luch et al.
4,907,709 A 3/1990 Abe et al.
5,067,622 A 11/1991 Garver et al.
5,097,974 A 3/1992 Rozenberg
5,103,991 A 4/1992 Collins
5,137,163 A 8/1992 Moore
5,178,289 A 1/1993 Krishnakumar et al.
5,213,225 A 5/1993 King et al.
5,248,050 A 9/1993 Janousch et al.
5,255,889 A 10/1993 Collette et al.
5,279,433 A 1/1994 Krishnakumar et al.
5,281,387 A 1/1994 Collette et al.
5,303,833 A 4/1994 Hayashi et al.
5,314,084 A 5/1994 Flota et al.
5,360,126 A 11/1994 Snyder et al.
5,407,086 A 4/1995 Ota et al.
5,487,481 A 1/1996 Sander et al.
5,494,174 A 2/1996 Rohr et al.
5,509,552 A 4/1996 Eguchi et al.
5,511,677 A 4/1996 Oder
5,603,422 A 2/1997 Herrmann
5,632,397 A 5/1997 Fandeux et al.
5,740,932 A 4/1998 Bettegazzore
5,743,419 A 4/1998 King
5,749,201 A 5/1998 Cochrane
5,915,579 A 6/1999 Przytulla et al.
5,975,321 A 11/1999 Luch
6,112,925 A 9/2000 Nahill et al.
6,248,413 B1 6/2001 Barel et al.
6,382,444 B1 5/2002 Nyman
6,523,710 B1 * 2/2003 Hidding ..... B65D 41/32 215/256
6,585,125 B1 7/2003 Peek
6,938,787 B2 9/2005 Shinozaki
7,334,696 B2 2/2008 Tanaka et al.
7,510,094 B1 3/2009 Willis et al.
7,637,384 B2 12/2009 Price et al.
7,819,264 B2 10/2010 Brozell et al.
7,942,287 B2 5/2011 King
8,091,724 B2 1/2012 King
8,268,216 B2 9/2012 Meador
8,328,038 B2 * 12/2012 Major ..... B29C 43/18 215/350
8,528,759 B2 9/2013 Pucci
8,544,666 B2 10/2013 Velmer et al.
9,033,168 B2 5/2015 Darr et al.
9,221,596 B2 12/2015 Patel et al.
9,994,350 B2 6/2018 Labadie et al.
10,377,534 B2 8/2019 Hanan
10,919,671 B2 2/2021 Hanan
2001/0000602 A1 5/2001 Luch
2002/0030031 A1 3/2002 Druitt et al.
2002/0037338 A1 3/2002 Lisch et al.
2002/0134747 A1 9/2002 Babcock et al.
2003/0127418 A1 7/2003 Schweigert et al.
2004/0094551 A1 * 5/2004 Mavin ..... B29C 65/5057 220/257.1
2005/0048235 A1 3/2005 Dygert
2005/0067365 A1 3/2005 Hanafusa et al.
2006/0021959 A1 2/2006 Falzoni
2006/0169666 A1 8/2006 Nyman et al.
2007/0023299 A1 2/2007 Clarkson
2007/0131644 A1 6/2007 Melrose
2008/0053949 A1 3/2008 Farrar et al.
2008/0073382 A1 3/2008 Higgins
2008/0116162 A1 5/2008 Penny
2009/0084751 A1 4/2009 Pucci
2010/0178148 A1 7/2010 Forsthoevel et al.
2010/0270259 A1 10/2010 Russell et al.
2010/0304169 A1 12/2010 Dambach
2010/0308054 A1 12/2010 Goria et al.
2010/0314348 A1 12/2010 Zoppas et al.
2011/0024423 A1 2/2011 Erspamaer et al.
2011/0115135 A1 5/2011 Siegl
2011/0278313 A1 11/2011 Labadie et al.
2012/0091091 A1 4/2012 Steinberger
2012/0305516 A1 12/2012 Kuzma et al.
2015/0027974 A1 1/2015 Niec
2017/0217646 A1 8/2017 Hanan
2018/0044072 A1 2/2018 Asakawa et al.
2018/0133948 A1 5/2018 Suyama et al.
2018/0229881 A1 8/2018 Jarman et al.
2018/0297752 A1 10/2018 Mai
2018/0327131 A1 11/2018 Hanan
2019/0367203 A1 12/2019 Okuyama et al.
2019/0375556 A1 12/2019 Hanan
2020/0031531 A1 1/2020 Hanan
2020/0071035 A1 3/2020 Hanan
2020/0198855 A1 6/2020 Sterling et al.

FOREIGN PATENT DOCUMENTS

EP 2687450 A1 1/2014
JP H072263 A 1/1995
JP H07149357 A 6/1995
JP 2006232392 A 9/2006
JP 2010285162 A 12/2010
WO 199728057 A1 8/1997
WO 2005073096 A1 11/2005
WO 2009122144 A1 10/2009
WO 2015189436 A1 12/2015
WO 2017136584 A1 8/2017
WO 2017183952 A1 10/2017

(56) References Cited

FOREIGN PATENT DOCUMENTS

| | | | |
|---|---|---|---|
| WO | 2020245250 | A1 | 12/2020 |
| WO | 2021005505 | A1 | 1/2021 |

OTHER PUBLICATIONS

Extended Search Report issued from the European Patent Office for related Application No. 19844771.6 dated Mar. 31, 2022 (9 Pages).

* cited by examiner

FIG. 3
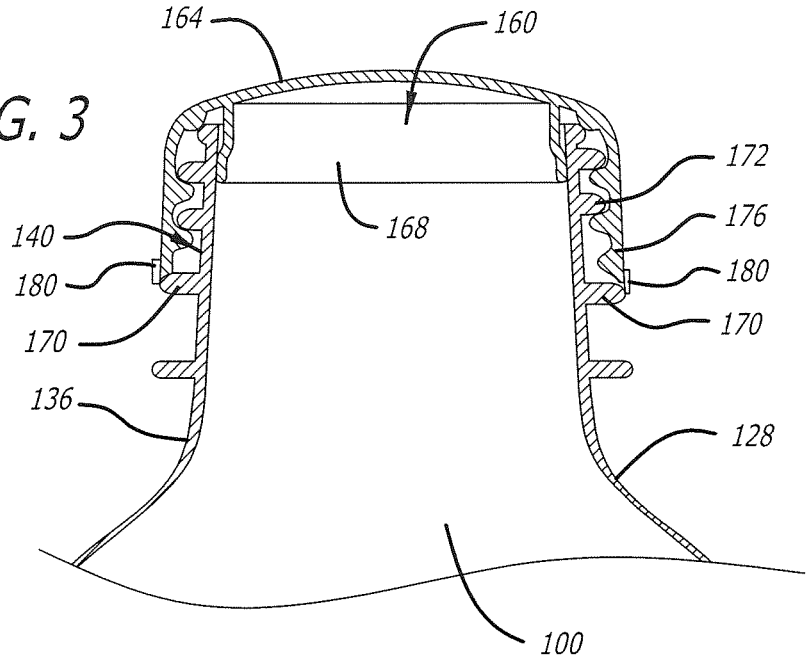
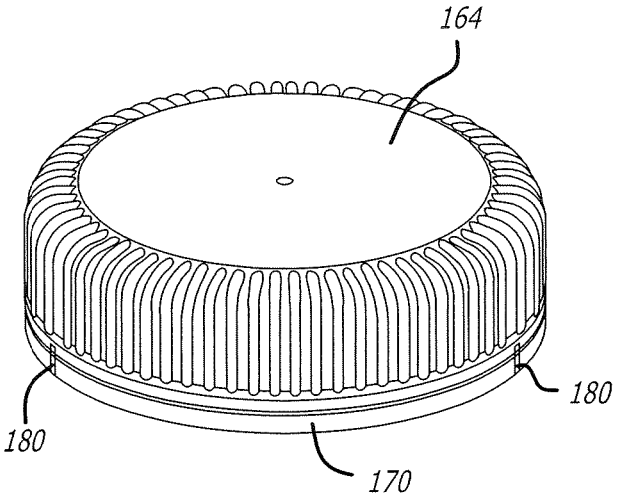
FIG. 4A
FIG. 4B
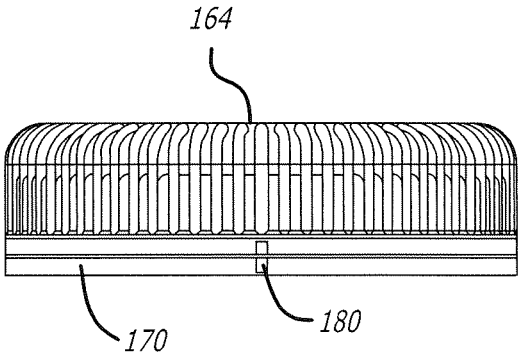

FIG. 7A
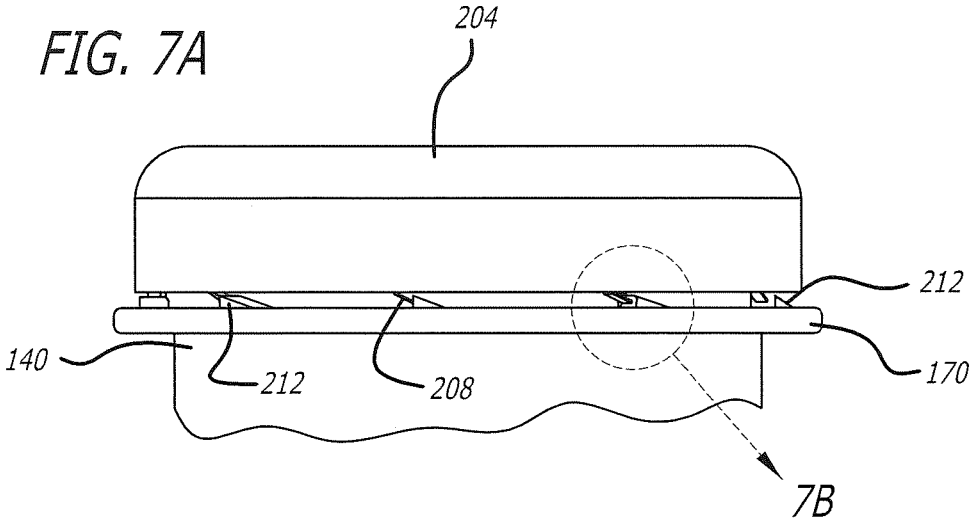
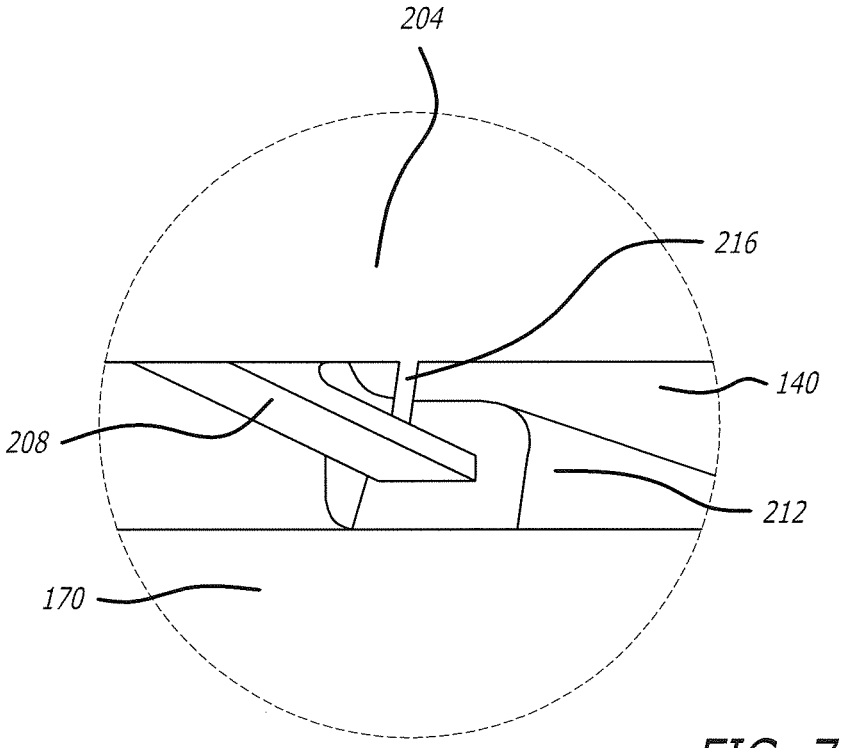
FIG. 7B

FIG. 8A
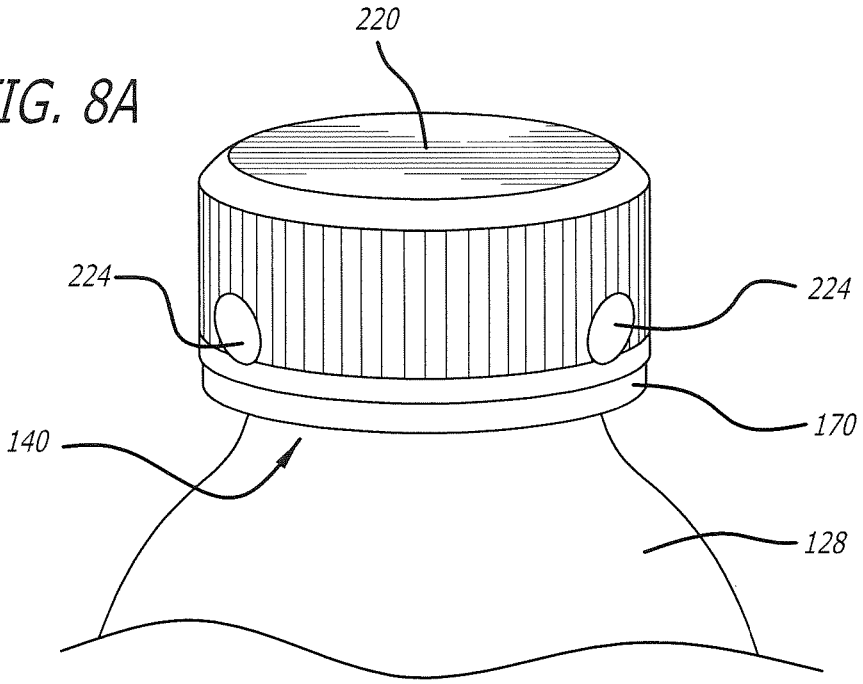
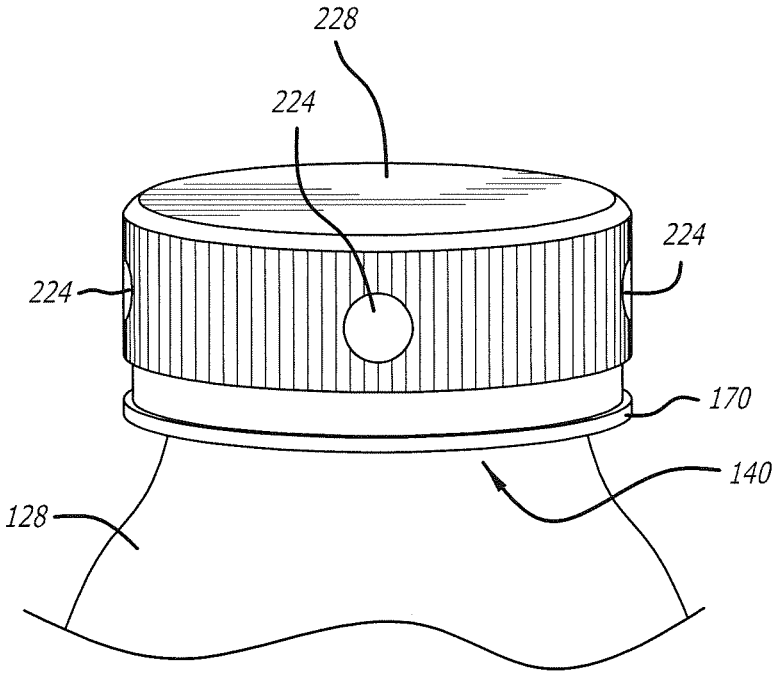
FIG. 8B

TAMPER EVIDENCE CONTAINER CLOSURE

PRIORITY

This application is a continuation of U.S. application Ser. No. 17/567,691, filed Jan. 3, 2022, which is a continuation of U.S. application Ser. No. 16/520,165, filed Jul. 23, 2019, now U.S. Pat. No. 11,214,410, which claims the benefit of and priority to U.S. Provisional Application, entitled "Tamper Evidence Container Closure," filed on Jul. 30, 2018 and having application Ser. No. 62/712,138, and also claims the benefit of and priority to U.S. Provisional Application, entitled "Cam-Locking Tamper Evidence Closure," filed on Aug. 29, 2018 and having application Ser. No. 62/724,538. This application is also a continuation of, and claims the benefit of, U.S. patent application, entitled "Tamper Evidence Bridges," filed on Feb. 2, 2017 and having application Ser. No. 15/423,383, which claims the benefit of and priority to U.S. Provisional Application, entitled "Tamper Evidence Bridges," filed on Feb. 2, 2016 and having application Ser. No. 62/290,434. Each of the aforementioned applications is incorporated by reference in its entirety into this application.

FIELD

The field of the present disclosure generally relates to plastic bottles and preforms. More particularly, the field of the invention relates to tamper evidence closures that provide visible indications of removal of the closures after installation by a manufacturer.

BACKGROUND

Plastic containers have been used as a replacement for glass or metal containers in the packaging of beverages for several decades. The most common plastic used in making beverage containers today is polyethylene terephthalate (PET). Containers made of PET are transparent, thin walled, and have the ability to maintain their shape by withstanding the force exerted on the walls of the container by their contents. PET resins are also reasonably priced and easy to process. PET bottles are generally made by a process that includes the blow-molding of plastic preforms which have been made by injection molding of the PET resin.

Advantages of plastic packaging include lighter weight and decreased breakage as compared to glass, and lower costs overall when taking both production and transportation into account. Although plastic packaging is lighter in weight than glass, there is still great interest in creating the lightest possible plastic packaging so as to maximize the cost savings in both transportation and manufacturing by making and using containers that contain less plastic.

FIG. 1 illustrates a side view of an exemplary container 100 typically used for storing liquid contents, and particularly carbonated contents. The container 100 comprises a base 104 that extends up to a grip portion 108. In some embodiments, the base 104 may be of a petaloid variety, although other configurations of the base 104 may be incorporated into the container 100, without limitation. The grip portion 108 comprises a generally smooth, cylindrical portion of the container 100 suitable for affixing a label, as well as providing a location for grasping the container 100. In some embodiments, the grip portion 108 may comprise one or more sidewall ribs that generally may vary in depth and may swirl or angulate around the grip portion 108. Additional configurations of the grip portion 108 are disclosed in U.S. patent application, entitled "Plastic Container with Strapped Base," filed on Jan. 16, 2014, having application Ser. No. 14/157,400, the entirety of which application is incorporated by reference herein.

In the illustrated embodiment, the grip portion 108 transitions into a shoulder 124, which connects to a bell 128. Although the bell 128 illustrated in FIG. 1 is smooth and generally unornamented, in other embodiments the bell may include design features, such as, by way of non-limiting example, a plurality of scallops. The bell 128 connects to a neck 136, which connects to a finish 140. As shown in FIG. 1, the bell 128 comprises a diameter that generally decreases as the bell 128 extends upward from the shoulder 124 to the neck 136 and the finish 140. The finish 140 may be adapted to receive a closure 164 to seal contents in the container 100, such as, by way of non-limiting example, a container cap or a bottle cap. The finish 140 generally defines an opening that leads to an interior of the container 100 for containing a beverage, or other contents. The embodiment of the finish 140 shown in FIG. 1 is of a Carbonated Soft Drink (CSD) variety but may be configured, in some embodiments, to receive closures suitable for sealing noncarbonated contents (for example, see FIG. 14) within the interior of the container 100.

FIG. 2 illustrates an upper perspective view of an exemplary finish 140 that is configured to rotatably engage with the closure 164 so as to seal contents within the interior of the container 100. The finish 140 comprises a cylindrical body 148 that includes a peripheral portion with a first edge 152 and a second edge 156 disposed at opposite ends. The first edge 152 defines an opening 160 and is configured to receive a plug seal 168, as shown in FIG. 3 comprising the closure 164, as disclosed herein. The second edge 156 is configured to receive the neck 136 of the container 100, as shown in FIGS. 1 and 2, such that the opening 160 is in fluid communication with the interior of the container 100 once the finish 140 is installed thereon.

An exterior of the cylindrical body 148 comprises one or more threads 172 that are configured to rotatably engage with one or more threads 176 of the closure 164. An engagement of the threads 172 of the finish 140 with the threads 176 of the closure 164 is best shown in FIG. 3. As shown in FIG. 2, a plurality of gaps 174 may be disposed in the threads 172 and positioned uniformly around the perimeter of the cylindrical body 148. Preferably, the gaps 174 of adjacent threads 172 are vertically aligned so as to form channels 178 extending longitudinally along the finish 140. The channels 178 advantageously operate to relieve pressure within the container 100 when the closure 164 is loosened. As will be appreciated, the channels 178 may provide a direct route for gases escaping the interior of the container 100, rather than the gases being forced to travel around the finish 140 between adjacent threads 172.

In the embodiment illustrated in FIG. 1, the closure 164 comprises a tamper evidence band 166 that is disposed around the perimeter of the finish 140. The tamper evidence band 166 is attached to the closure 164 by a multiplicity of thin connections. A tamper evidence ledge 170, best shown in FIG. 2, generally comprises a rounded upper portion configured to facilitate passing the tamper evidence band 166 over the tamper evidence ledge 170 during assembly of the closure 164 onto the container 100. A flat lower portion of the tamper evidence ledge 170 retains the tamper evidence band 166 positioned below the tamper evidence ledge 170 during loosening of the closure 164. For example, when an end-user later loosens the closure 164, the tamper evidence ledge 170 retains the tamper evidence band 166 positioned below the tamper evidence ledge 170, breaking the thin connections between tamper evidence band and the closure 164. The tamper evidence band 166 remains positioned below the tamper evidence ledge 170 after the closure 164 is removed from the container 100. Thus, the tamper evidence band 166 and tamper evidence ledge 170 cooperate to indicate to the end-user that the closure 164 has not been previously loosened after being installed by the manufacturer.

A drawback to conventional tamper evidence bands, such as the band 166, is that it may be difficult for an end-user to directly observe whether or not the closure 164 has been previously separated from the tamper evidence band 166 and removed from the container. Consequently, the closure 164 may be separated from the tamper evidence band 166, the container, 100 may be refilled, and another closure may be installed onto the container, giving little visual indication to the end-user that the container 100 has been reused. One solution to this problem has been to make the finish 140 taller so that the second edge 156 is lower, allowing the tamper evidence band 166 to drop once the closure 164 has been separated from the container 100. Unfortunately, making the finish 140 taller generally adds unwanted weight to the container 100. Further, in some instances the tamper evidence band 166 may be removed from the finish 140 and a new closure 164 may be placed onto the container 100, leaving a consumer with essentially no evidence that the container 100 had been previous opened.

Moreover, in some instances the tamper evidence band 166 may fail to detach from the closure 164 upon being loosened, thereby making it difficult for an end-user to directly observe whether or not the closure 164 has been previously separated from the container 100. Consequently, the closure 164 and the tamper evidence band 166 may be removed from the container 100, the container 100 may be refilled, and another closure 164 with a tamper evidence band 166 may be installed onto the container 100, giving little visual indication to the end-user that the container 100 has been reused.

Another drawback to conventional tamper evidence bands 166 is that the closure 164 generally must be screwed onto the finish 140 by way of a chuck. A solution to this drawback has been to merely push the closure onto the finish 140, such that the threads 176 snap onto the threads 172 and the tamper evidence band 166 is retained below the tamper evidence ledge 170. A drawback to pushing the closure 164 onto the finish 140 is that snapping the threads 172, 176 together typically requires the threads 172, 176 to be short enough to allow internal pressure within the container to force the closure 164 off the finish 140. As will be recognized, such an internal pressure may be due to heat, dissolved gas, or even due to a consumer squeezing the bottle.

What is needed, therefore, is a tamper evidence bridge that provides a visible indication about whether or not a closure has been removed from a plastic container after having been installed by a manufacturer. Further, there is a need for a reduction of turbulence in liquid contents during pushing the closure onto the finish during manufacturing as well as a design that resists being pushed off the bottle by internal pressure.

SUMMARY

An apparatus and a method are provided for a closure comprising a plurality of tamper evidence bridges configured to provide evidence that the closure has been removed from a container by other than a manufacturer of the container. The tamper evidence bridges comprise a small tab of material that extends from a bottom-most edge of the closure to a neck ring of the container. The tamper evidence bridges are configured to break, or snap, when the closure is rotated relative to the neck ring. Broken tamper evidence bridges provide readily visible evidence to an end-user of the container that the closure has been removed by other than the manufacturer of the container. The high visibility of the tamper evidence bridges serves to discourage vendors from attempting to refill and resale of the used containers.

In some embodiments, a tamper evidence closure includes interior threads configured to engage with threads of a finish of the container. A tamper evidence portion is disposed around the perimeter of a lower portion of the tamper evidence closure. Cam locks are disposed in the tamper evidence portion and configured to be permanently flared by cams on the finish during loosening of the closure. Outward flaring of the cam locks provides a visual indication that the tamper evidence closure has been loosened after installation by a manufacturer.

In an exemplary embodiment, a container for providing visible evidence of having been opened after being sealed by a manufacturer of the container comprises: a base extending upward to a sidewall of the container; a shoulder connected between the sidewall and a bell, a diameter of the bell decreasing as the bell extends upward to a neck of the container; a finish connected to the neck and defining an opening to an interior of the container, the finish including a tamper evidence ledge; a tamper evidence closure configured to couple with the finish; and at least one tamper evidence bridge coupled with the tamper evidence closure and the finish, the at least one tamper evidence bridge being configured to break when the tamper evidence closure is rotated relative to the finish.

In another exemplary embodiment, the at least one tamper evidence bridge comprises a small tab of material that extends from a bottom-most edge of the tamper evidence closure to a tamper evidence ledge comprising the finish. In another exemplary embodiment, the at least one tamper evidence bridge is comprised of a material that is capable of visibly breaking when the tamper evidence closure is turned with respect to the finish. In another exemplary embodiment, the at least one tamper evidence bridge comprises one or more portions of the tamper evidence closure that are melted directly into a portion of the finish under the tamper evidence closure. In another exemplary embodiment, the at least one tamper evidence bridge comprises a tab extending from the tamper evidence closure to a notch disposed in the perimeter of a tamper evidence ledge comprising the finish, the tab being affixedly retained in the notch.

In another exemplary embodiment, the tamper evidence closure includes a tamper evidence band that is fixedly coupled with the finish by way of the at least one tamper evidence bridge, such that the at least one tamper evidence bridge keeps the tamper evidence band attached to the finish after the tamper evidence closure is removed from the finish. In another exemplary embodiment, the tamper evidence closure is configured to directly contact the tamper evidence ledge when the tamper evidence closure is fully coupled with the finish. In another exemplary embodiment, the tamper evidence ledge is configured to include a diameter that aligns an exterior of the tamper evidence ledge with the exterior of the tamper evidence closure. In another exemplary embodiment, a bottom-most edge of the tamper evidence closure is affixed directly to the tamper evidence ledge, such that the tamper evidence closure breaks loose from the tamper evidence ledge upon being turned with respect to the tamper evidence ledge.

In an exemplary embodiment, a tamper evidence closure configured to engage with a finish so as to seal contents within an interior of a container comprises: interior threads configured to engage with threads of the finish; a plug seal configured to extend into an opening of the finish whereby contents are sealed in the interior of the container; a tamper evidence portion disposed around the perimeter of a lower portion of the tamper evidence closure; and one or more cam locks disposed in the tamper evidence portion and configured to be outwardly flared by the finish when the tamper evidence closure is turned with respect to the finish.

In another exemplary embodiment, the one or more cam locks are configured to remain flared to indicate that the tamper evidence closure has been loosened after being installed onto the container by a manufacturer. In another exemplary embodiment, the one or more cam locks each comprises a recess disposed in an interior of the tamper evidence closure and configured to receive a cam disposed on the finish. In another exemplary embodiment, the recess is configured to interfere with the cam when the tamper evidence closure is turned with respect to the finish. In another exemplary embodiment, the cam is configured to permanently flare the one or more cam locks to provide a visual indication that the tamper evidence closure has been loosened after being installed by a manufacturer.

In an exemplary embodiment, a finish configured to engage with a closure so as to seal contents within an interior of a container comprises: a cylindrical body that begins at an opening to an interior of the container and extends to and includes a tamper evidence ledge; threads configured to provide a means to fasten the closure to the container; and at least one cam disposed between the tamper evidence ledge and a bottom-most of the threads.

In another exemplary embodiment, the at least one cam is configured to interfere with at least one cam lock disposed in a tamper evidence portion of the closure for the purpose of indicating whether or not the closure has been loosened after being installed by a manufacturer. In another exemplary embodiment, the at least one cam lock includes a ramped surface that comprises a decreasing thickness of the tamper evidence portion and terminates at a flat surface; and wherein the flat surface comprises a relatively thin portion of the tamper evidence portion that extends from the ramped surface to a blunt surface. In another exemplary embodiment, the blunt surface is substantially perpendicular to the flat surface and configured to interfere with the cam during loosening of the closure on the finish.

In another exemplary embodiment, a recess is disposed in an interior of the closure and configured to receive the at least one cam upon the closure being installed onto the finish by a manufacturer. In another exemplary embodiment, the at least one cam is configured to interfere with a blunt surface comprising the recess during loosening of the closure with respect to the finish. In another exemplary embodiment, the at least one cam is configured to push outward and flare the blunt surface to provide a visual indication that the closure has been loosened after being installed by the manufacturer.

BRIEF DESCRIPTION OF THE DRAWINGS

The drawings refer to embodiments of the present disclosure in which:

FIG. 3 is a cross-sectional view illustrating an exemplary embodiment of tamper evidence bridges between an exemplary finish and an exemplary closure, according to the present disclosure;

FIG. 4A illustrates a perspective view of an exemplary embodiment of tamper evidence bridges between an exemplary tamper evidence ledge and an exemplary closure in accordance with the present disclosure;

FIG. 4B illustrates a side plan view of the tamper evidence bridges illustrated in FIG. 4A, according to the present disclosure;

FIG. 7A illustrates a side plan view of an exemplary embodiment of a tamper evidence closure, in accordance with the present disclosure;

FIG. 7B illustrates a close-up view of a scale and a bridge comprising the tamper evidence closure illustrated in FIG. 7A;

FIG. 8A illustrates a perspective view of an exemplary embodiment of a tamper evidence closure, according to the present disclosure;

FIG. 8B illustrates a perspective view of an exemplary embodiment of a tamper evidence closure, in accordance with the present disclosure;

Figure 1:
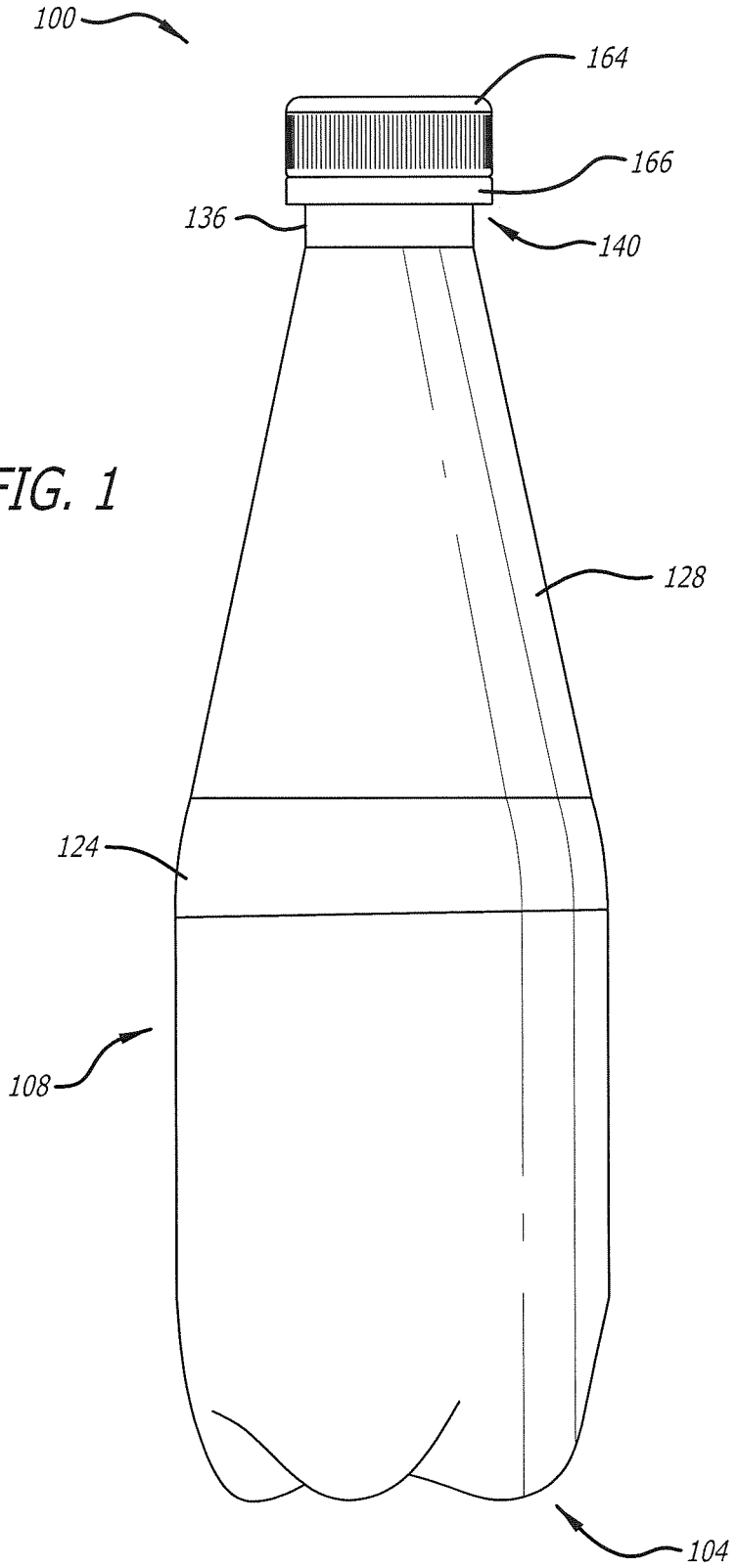
FIG. 1 illustrates a side view of an exemplary container suitable for storing pressurized carbonated contents.

While the present disclosure is subject to various modifications and alternative fait's, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first bottle," may be made. However, the specific numeric reference should not be interpreted as a literal sequential order but rather interpreted that the "first bottle" is different than a "second bottle." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure provides an apparatus and method for a closure comprising a plurality of tamper evidence bridges configured to provide evidence that the closure has been removed from a container by other than a manufacturer of the container. Each of the tamper evidence bridges comprises a small tab of material that extends from a bottom-most edge of the closure to a tamper evidence ledge of the container. The tamper evidence bridges are configured to break, or snap, when the closure is rotated relative to the tamper evidence ledge. Broken tamper evidence bridges provide readily visible evidence to an end-user of the container that the closure has been removed by other than the manufacturer of the container. In some embodiments, the closure includes a tamper evidence band attached to the tamper evidence ledge by the tamper evidence bridges. The tamper evidence bridges keep the tamper evidence band attached to the tamper evidence ledge after the closure is removed from the finish. The high visibility of the tamper evidence bridges serves to discourage vendors from attempting to refill and resale of the used containers.

FIG. 3 illustrates a cross-sectional view of an exemplary embodiment of a finish 140 with a closure 164 installed, according to the present disclosure. The closure 164 illustrated in FIG. 3 is substantially similar to the closure 164 illustrated in FIG. 1, with the exception that the closure 164 of FIG. 3 includes a plurality of tamper evidence bridges 180 in lieu of the tamper evidence band 166. As best illustrated in FIGS. 4A and 4B, each of the plurality of tamper evidence bridges 180 comprises a small tab of material that generally extends from a bottom-most edge of the closure 164 to the tamper evidence ledge 170. The tamper evidence bridges 180 are configured to break, or snap, when the closure 164 is rotated relative to the tamper evidence ledge 170. Broken tamper evidence bridges 180 providing readily visible evidence to an end-user of the container 100 that the closure 164 has been removed by other than the manufacturer of the container 100. As will be appreciated, therefore, the highly visible tamper evidence bridges 180 serve to discourage vendors from attempting to refill and resale of the used containers.

In some embodiments, the tamper evidence bridges 180 may comprise separate components that are bonded onto the closure 164 and the tamper evidence ledge 170. In general, any of various methods may be used to bond the tamper evidence bridges 180 to the closure 164 and the tamper evidence ledge 170, including, but not necessarily limited to, any of various suitable adhesives or melting the bridges onto adjacent portions of the closure 164 and the tamper evidence ledge 170 by way of any suitable heat source. In some embodiments, the tamper evidence bridges 180 may be comprised of a material that is substantially similar to the material comprising the closure 164 or the finish 140.

In some embodiments, the tamper evidence bridges 180 may be comprised of any material that is found to be capable of visibly breaking when the closure 164 is turned with respect to the tamper evidence ledge 170, as described above. For example, in an embodiment illustrated in FIGS. 5A-5B, the tamper evidence bridges 180 are comprised of a wax indicator dot. Thus, when the end-user turns the closure 164, the wax indicator dot breaks, providing visible evidence to the end-user that the container 100 has been opened. In still some embodiments, one or more portions of the closure 164 may be melted directly into the finish 140 under the closure 164, in lieu of being bridged to the tamper evidence ledge 170, as described above. In such embodiments, a hot wire or other suitable tool may be utilized to press the sidewall of the closure directly against the finish 140. Further, in some embodiments, the tamper evidence ledge 170 may be omitted from the finish 140 and the closure 164 may be molded directly to any of various suitable features of the finish 140. As will be appreciated, such embodiments may advantageously reduce the amount of material comprising the finish 140 and the closure 164.

In the embodiment illustrated in FIGS. 4A-4B, the tamper evidence bridges 180 are formed by melting and joining a small portion of the closure 164 and a small portion of the tamper evidence ledge 170 by way of a laser. As will be appreciated, laser melting and joining advantageously reduces the amount of material that must be used to form the finish 140 and the closure 164. In the embodiment of FIGS. 4A-4B, incorporating the tamper evidence bridges 180 reduces the material comprising the closure 164 by substantially 0.1 grams, or about 14%, and reduces the material comprising the finish 140 by substantially 18%.

Figure 6A:
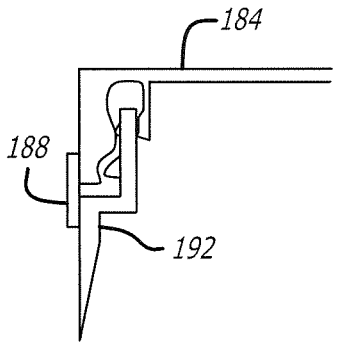
FIG. 6A illustrates a cross-sectional view of an exemplary embodiment of a tamper evidence bridge molded to a closure and a finish, in accordance with the present disclosure.
Figure 6B:
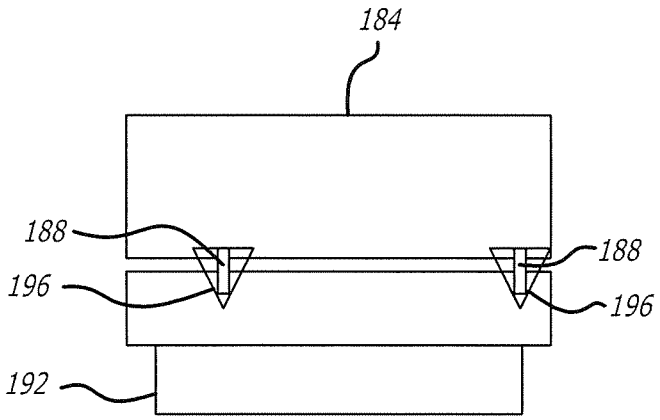
FIG. 6B illustrates a side plan view of the tamper evidence bridge molded to the closure and the finish as illustrated in FIG. 6A, according to the present disclosure.

In some embodiments, however, a physical tab may be injection molded onto the closure 164 and then laser melted onto a geometric feature, such as a well, on the tamper evidence ledge 170. For example, in the embodiment illustrated in FIGS. 6A-6B, a closure 184 comprises a plurality of tamper evidence bridges 188 that are formed as a portion of the closure by way of injection molding. A finish 192 of the container 100 comprises a plurality of wells 196 disposed around the perimeter of the finish so as to be coincide with the tamper evidence bridges 188 when the closure 184 is tightly sealed with the finish 192. During manufacturing or bottling, the container 100 may be filled with liquid contents and the closure 184 tightly installed onto the finish 192, such that the tamper evidence bridges 188 are positioned within the wells 196. Assembly of the tamper evidence bridges 188 may be completed upon laser melting the tamper evidence bridges 188 onto the wells, as shown in FIG. 6B.

With reference again to FIGS. 4A-4B, the plurality of tamper evidence bridges 180 may be evenly spaced around the perimeter of the closure 164 and the tamper evidence ledge 170. For example, in the illustrated embodiment, three tamper evidence bridges 180 are spaced at substantially 120-degree intervals with respect to the closure 164. It should be understood, however, that the number of tamper evidence bridges 180 may be more or less than three, and the intervals between adjacent tamper evidence bridges 180 need not be limited to 120-degrees. In some embodiments, for example, four tamper evidence bridges 180 may be disposed at substantially 90-degree intervals around the perimeter of the closure 164. Further, the tamper evidence bridges 180 need not be limited to uniform spacing around the perimeter of the finish, but rather the tamper evidence bridges 180 may be positioned around of the perimeter with any suitable spacing between adjacent tamper evidence bridges without deviating beyond the spirit and scope of the present disclosure.

Figure 5A:
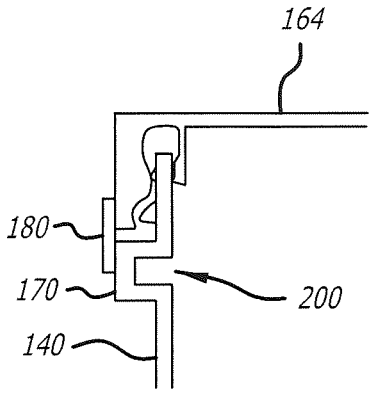
FIG. 5A illustrates a cross-sectional view of an exemplary embodiment of a tamper evidence bridge coupling a closure and a finish, in accordance with the present disclosure.
Figure 5B:
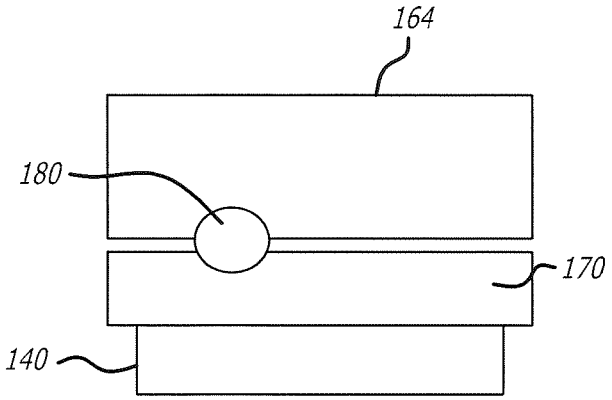
FIG. 5B illustrates a side plan view of the tamper evidence bridge coupling the closure and the finish as illustrated in FIG. 5A, according to the present disclosure.

Moreover, it should be recognized that incorporating the plurality of tamper evidence bridges 180 into the finish 140 and closure 164 may substantially improve the efficiency of filling and capping of the container 100 during manufacturing or bottling. As will be recognized, pushing the closure 164 directly onto the finish 140 is faster and relatively more efficient than using a chuck to screw the closure 164 onto the finish 140. In absence of a conventional tamper evidence band 166, the closure 164 may be quickly pushed onto the finish 140 and the tamper evidence bridges 180 welded with relatively greater efficiency. Further, absence of the conventional tamper evidence band 166 facilitates incorporating features within the finish 140 that may operate to reduce turbulence or waves in the liquid contents during filling and capping of the container. In some embodiments, for example, the finish 140 may be configured to include a pocket 200 within an interior of the tamper evidence ledge 170, as shown in FIG. 5A. Those skilled in the art will appreciate that the pocket 200 may operate to reduce spilling of the liquid contents due to waves and turbulence during filling and capping of the container 100.

FIG. 7A illustrates a side plan view of an exemplary embodiment of a tamper evidence closure 204, in accordance with the present disclosure. A multiplicity of scales 208 are uniformly disposed around the circumference of a bottom-most edge of the closure 204 and engagedly coupled with a similar multiplicity of ramps 212 extending from an upper-most surface of the tamper evidence ledge 170. In general, an equal number of scales 208 and ramps 212 may be respectively disposed around the circumference of the closure 204 and the tamper evidence ledge 170. It is contemplated, however, that any number of scales and ramps 208, 212 may be incorporated into the closure 204 and the tamper evidence ledge 170, without limitation, and thus the number of scales and ramps 208, 212 is not to be limited to the number shown in FIG. 7A. Further, the scales and ramps 208, 212 need not be limited to uniform spacing around the circumference of the closure 204 and the tamper evidence ledge 170, but rather the scales and ramps may be positioned around the circumference with any suitable spacing between adjacent scales and ramps without deviating beyond the spirit and scope of the present disclosure.

As best shown in FIG. 7B, each scale 208 is comprised of a small tab of material that extends from the bottom-most edge of the closure 204 in a counterclockwise direction with respect to the top of the closure. Further, each ramp 212 is comprised of a raised portion of the material extending from an upper-most surface of the tamper evidence ledge 170 in a clockwise direction with respect to the top of the closure 204. Preferably, the ramps 212 are positioned on the tamper evidence ledge 170 so as to engage with the scales 208, as shown in FIG. 7B, when the closure 204 is suitably tightened onto the finish 140.

It will be recognized that the scales 208 and the ramps 212 are oriented towards one another, thereby biasing the closure 204 in favor of being tightened onto the finish 140. In the event that an end-user attempts to turn the closure 204 in the counterclockwise direction, the scales 208 forcibly contact the ramps 212 and resist loosening of the closure 204. As shown in FIG. 7B, a bridge 216 couples the end of each scale 208 with the closure 204. The bridges 216 are configured to break, snap, or bend when the closure 204 is loosened, or rotated counterclockwise, relative to the tamper evidence ledge 170. When the bridges 216 break or bend, further loosening of the closure 204 causes the ramps 212 to bend or break the scales 208 and allow the closure 204 to be removed from the finish 140. Broken or bent bridges 216 and scales 208 provide readily visible evidence to the end-user that the closure 204 has been removed from the container 100 after having been installed by the manufacturer. As will be appreciated, therefore, the tamper evidence closure 204 serves to discourage vendors from attempting to refill and resale used containers.

FIG. 8A illustrates a perspective view of an exemplary embodiment of a tamper evidence closure 220, according to the present disclosure. The tamper evidence closure 220 is similar to the closure 164, illustrated in FIG. 1, with the exception that the tamper evidence closure 220 is comprised of one or more thin film areas 224 disposed on the side of the closure 220. The thin film areas 224 generally comprise regions of the closure 220 that are much thinner than other regions of the closure. It is contemplated that the thin film areas 224 may be each coupled with a bridge (not shown) or other similar structure that is attached to the finish 140, such that the bridges tear or remove the thin film areas 224 during loosening of the closure 220. Torn or missing thin film areas 224 provides directly visible evidence to the end-user that the closure 220 has been removed by other than the manufacturer of the container 100, and thus the tamper evidence closure 220 serves to discourage refilling and resale used containers by vendors. It will be further appreciated that incorporating one or more thin film areas 224 in the closure 220 advantageously reduces the reduces the amount of material that must be used to form the closure 220.

In some embodiments, the thin film areas 224 may be disposed on the closure 220 so as to be located near the threads 172 of the finish 140, or the thin film areas 224 may be located nearby the bottom-most edge of the closure 220. Further, any number of thin film areas 224 may be incorporated into the closure 220 and the tamper evidence ledge 170, without limitation. For example, the tamper evidence closure 220 illustrated in FIG. 8A is comprised of three thin film areas 224. Alternatively, FIG. 8B illustrates an exemplary embodiment of a tamper evidence closure 228 that includes four thin film areas 224. Thus, it should be understood that the number of thin film areas 224 is not to be limited to the numbers shown in FIGS. 8A and 8B. Moreover, the thin film areas 224 need not be limited to uniform spacing around the circumference of the closure, but rather the thin film areas 224 may be positioned around the circumference with any suitable spacing between adjacent thin film areas 224 without deviating beyond the spirit and scope of the present disclosure.

Figure 9:
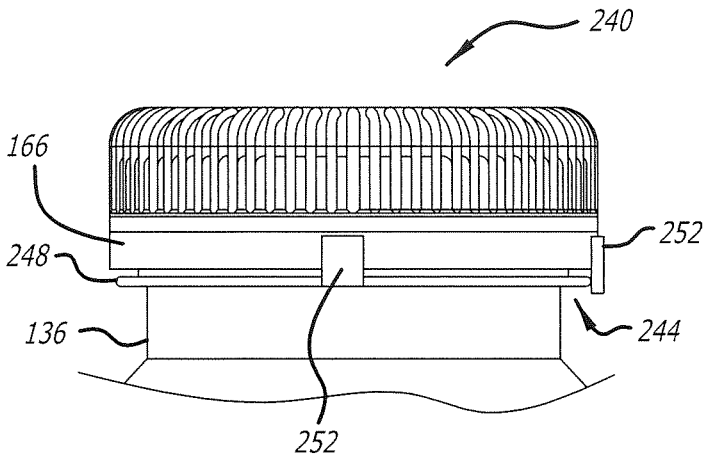
FIG. 9 illustrates a side plan view of an exemplary embodiment of a tamper evidence closure coupled with a finish, according to the present disclosure.

FIG. 9 illustrates a side plan view of an exemplary embodiment of a tamper evidence closure 240 coupled with a finish 244 according to the present disclosure. The finish 244 is similar to the finish 140, discussed with reference to FIG. 2, with the exception that the finish 244 includes a tamper evidence ledge 248 in lieu of the tamper evidence ledge 170 discussed hereinabove. Similar to the second edge 156 of FIG. 2, the tamper evidence ledge 248 is configured to receive the neck 136 of the container 100, as shown in FIGS. 1 and 2, such that the opening of the finish 244 is in fluid communication with the interior of the container 100 once the finish 244 is installed thereon.

Figure 2:
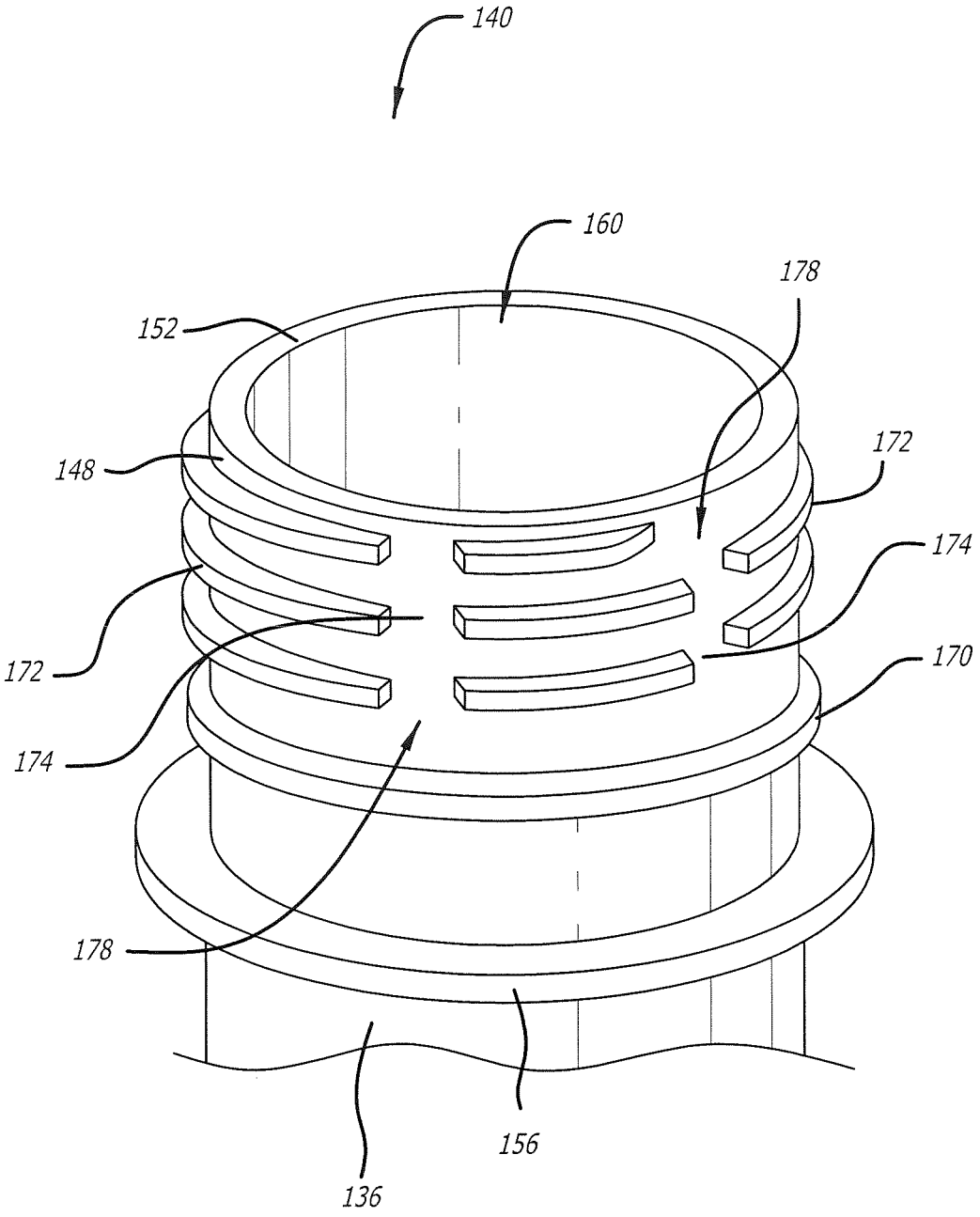
FIG. 2 illustrates an upper perspective view of an exemplary finish.

The tamper evidence closure 240 is similar to the closure 164, discussed with respect to FIG. 1, with the exception that the closure 240 is particularly suitable for use with finishes lacking the tamper evidence ledge 170, such as the finish 244. As shown in FIG. 9, the tamper evidence closure 240 includes a tamper evidence band 166 that is configured to be disposed around the perimeter of the finish 244. The tamper evidence band 166 is attached to the closure 240 by a multiplicity of thin connections that break loose when the closure 240 is loosened. A multiplicity of tamper evidence bridges 252 fixedly bond the tamper evidence band 166 to the tamper evidence ledge 248. Thus, when an end-user loosens the closure 240, the thin connections between tamper evidence band 166 and the closure 240 break, and the bridges 252 keep the tamper evidence band 166 attached to the tamper evidence ledge 248.

As will be appreciated, the bridges 252 are configured to keep the tamper evidence band 166 attached to the tamper evidence ledge 248 after the closure 240 is removed from the container 100. It is contemplated that the bridges 252 may be attached to the tamper evidence band 166 and the tamper evidence ledge 252 by way of any of various bonding techniques, including, but not limited to ultrasonic welding and the like. As such, the tamper evidence band 166, the bridges 252 and the tamper evidence ledge 248 cooperate to indicate to the end-user that the closure 240 has not been loosened after being installed by the manufacturer.

Figure 10A:
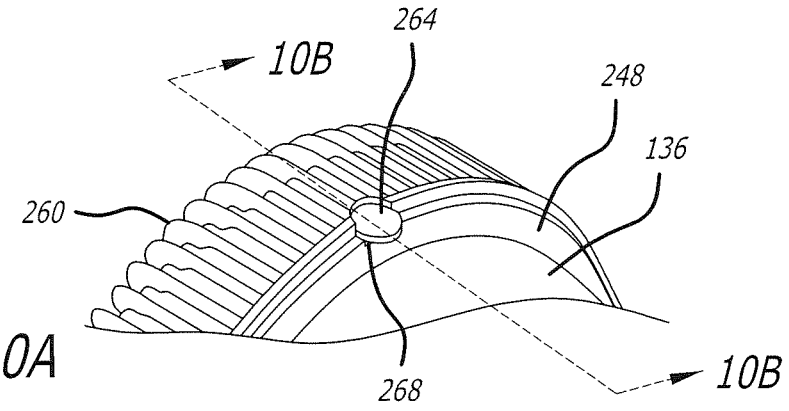
FIG. 10A illustrates an isometric view of an exemplary embodiment of a tamper evidence closure that is configured to cooperate with a tamper evidence ledge to provide evidence of tampering to an end-user of the container.
Figure 10B:
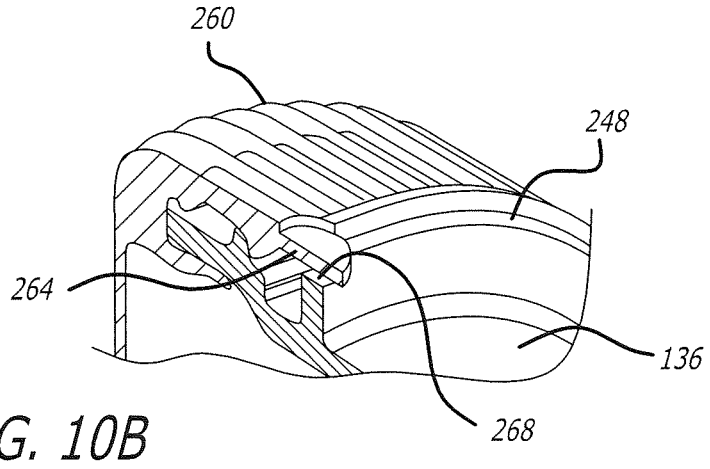
FIG. 10B illustrates a cutaway view of the tamper evidence closure and the tamper evidence ledge of FIG. 10A, taken along line 10B-10B.

FIGS. 10A and 10B illustrate an exemplary embodiment of a tamper evidence closure 260 that is configured to cooperate with the tamper evidence ledge 248 to provide evidence of tampering to an end-user of the container 100. The tamper evidence closure 260 is similar to the closure 240, with the exception that the closure 260 includes a plurality of tamper evidence bridges 264, in lieu of the tamper evidence band 166. Each tamper evidence bridge 264 comprises a small tab of material that generally extends from a bottom-most edge of the closure 260 into a notch 268 disposed in the tamper evidence ledge 248. In general, the tamper evidence bridges 264 are configured to break, or snap, when the closure 260 is rotated relative to the tamper evidence ledge 248. Broken tamper evidence bridges 264 provide readily visible evidence to the end-user that the closure 260 has been removed by other than the manufacturer of the container 100.

In some embodiments, the tamper evidence bridges 264 comprise portions of the closure 260 that are configured to extend into the notches 268. In some embodiments, however, the tamper evidence bridges 264 may comprise separate components that are bonded onto the closure 260 and into the notches 268. It is contemplated that any of various techniques may be employed to bond the tamper evidence bridges 264 to the closure 260 and the tamper evidence ledge 252, including, but not necessarily limited to, any of various suitable adhesives, ultrasonic welding, melting by way of any suitable heat source, and the like.

With continuing reference to FIGS. 10A-10B, the plurality of tamper evidence bridges 264 may be evenly spaced around the perimeter of the closure 260 and the tamper evidence ledge 252. For example, in some embodiments, three tamper evidence bridges 264 are spaced at substantially 120-degree intervals with respect to the closure 260. It should be understood, however, that the number of tamper evidence bridges 264 may be more or less than three, and the intervals between adjacent of the tamper evidence bridges 264 need not be limited to 120-degrees. In some embodiments, for example, four tamper evidence bridges 264 may be disposed at substantially 90-degree intervals around the perimeter of the closure 260. Further, the tamper evidence bridges 264 need not be limited to uniform spacing around the perimeter of the finish 244, but rather the tamper evidence bridges 264 may be positioned around the perimeter with any suitable spacing between adjacent tamper evidence bridges without deviating beyond the spirit and scope of the present disclosure.

Figure 11:
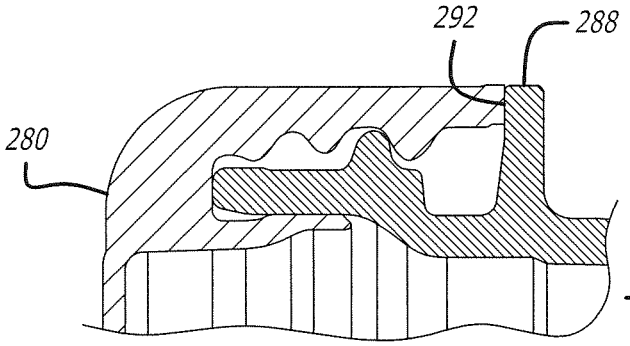
FIG. 11 illustrates a side view of an exemplary embodiment of a tamper evidence closure coupled with a finish that includes a tamper evidence ledge, in accordance with the present disclosure.
Figure 12:
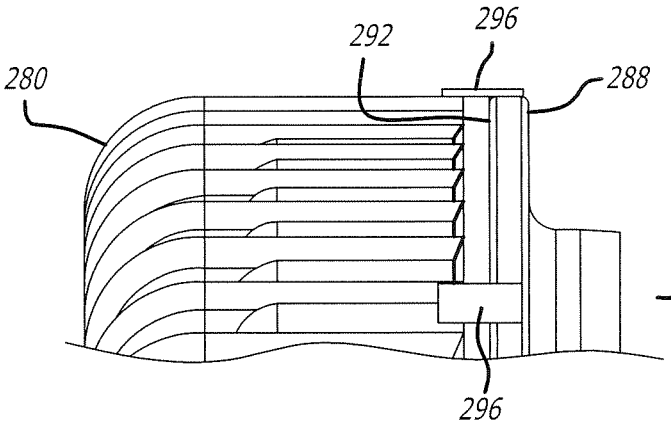
FIG. 12 illustrates a side view of an exemplary embodiment of a tamper evidence closure coupled with a finish that includes a tamper evidence ledge, in accordance with the present disclosure.

Turning now to FIGS. 11-12, an exemplary embodiment of a tamper evidence closure 280 is shown coupled with a finish 284 that includes a tamper evidence ledge 288, in accordance with the present disclosure. The closure 280 is similar to the closure 164, shown in FIG. 3, with the exception that the closure 280 is configured to directly contact the tamper evidence ledge 288 when fully coupled with the finish 284. The tamper evidence ledge 288 is generally similar to the tamper evidence ledge 248 but includes a diameter that aligns the exterior of the tamper evidence ledge 248 with the exterior of the closure 280.

In the embodiments illustrated in FIGS. 11-12, a bottom-most edge 292 of the tamper evidence closure 280 is affixed directly to the tamper evidence ledge 288, such that the closure 280 breaks loose from the tamper evidence ledge 288 upon the closure 280 being turned by an end-user. The bottom-most edge 292 may be affixed to the tamper evidence ledge 288 by way of any of various suitable techniques that allow for hand-turning of the closure 280, including, but not necessarily limited to, any of various suitable adhesives, ultrasonic welding, and the like.

In the embodiment illustrated in FIG. 12, a plurality of tamper evidence bridges 296 are coupled with the closure 280 and the tamper evidence ledge 288 either additionally or alternatively to the bottom-most edge 292 being bonded to the tamper evidence ledge 288. The tamper evidence bridges 296 are substantially identical to the bridges 180, discussed in connection with FIG. 3, and thus the bridges 296 are configured to break, or snap, when the closure 280 is rotated relative to the tamper evidence ledge 288. In addition to the bond between the bottom-most edge 292 and the tamper evidence ledge 288, broken tamper evidence bridges 296 provide readily visible evidence to the end-user that the closure 280 has been removed by other than the manufacturer of the container 100.

Figure 13:
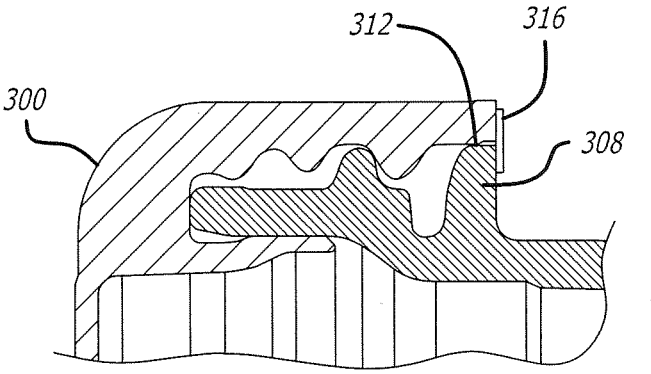
FIG. 13 illustrates a side view of an exemplary embodiment of an extended tamper evidence closure that is coupled with a finish of a container according to the present disclosure.

FIG. 13 illustrates an exemplary embodiment of an extended tamper evidence closure 300 that is coupled with a finish 304 according to the present disclosure. The embodiment of the finish 304 shown in FIG. 13 is similar to the finish 284, shown in FIG. 11, with the exception that the finish 304 includes a tamper evidence ledge 308 that has a diameter that allows the closure 300 to extend over an exterior edge 312 of the tamper evidence ledge 308. Thus, when the closure 300 is fully engaged with the finish 304, the interior of the closure 300 directly contacts the circumference of the exterior edge 312 of the tamper evidence ledge 308.

In some embodiments, the exterior edge 312 is affixed to the interior of the closure 300, such that the closure 300 breaks loose from the tamper evidence ledge 308 when the closure 300 is turned by an end-user. The exterior edge 312 may be affixed to the tamper evidence ledge 308 by way of any of various suitable techniques that allow for hand-turning of the closure 300, including, but not necessarily limited to, any of various suitable adhesives, ultrasonic welding, and the like. It should be understood that an entirety of the circumference of the tamper evidence ledge 308 need not be affixed to the interior of the closure 300. Rather, in some embodiments, one or more portions of the circumference of the tamper evidence ledge 308 may be affixed to the interior of the closure 300. Further, in some embodiments, a plurality of small portions of the circumference of the tamper evidence ledge 308 may be affixed to the interior of the closure 300 and configured to break loose upon being turned by an end-user.

As further shown in FIG. 13, one or more tamper evidence bridges 316 may be coupled with the closure 300 and configured to provide visible evidence to the end-user that the closure 300 has been removed from the container 100 after having been installed by the manufacturer. In the illustrated embodiment of FIG. 13, the tamper evidence bridges 316 are bonded to a bottom-most edge of the closure 300 and the tamper evidence ledge 308. The tamper evidence bridges 316 are substantially identical to the bridges 180, discussed in connection with FIG. 3, and thus the tamper evidence bridges 316 are configured to break, or snap, when the closure 300 is rotated relative to the tamper evidence ledge 308. It is contemplated that any of various techniques may be employed to bond the tamper evidence bridges 316 to the closure 300 and the tamper evidence ledge 308, including, but not necessarily limited to, any of various suitable adhesives, ultrasonic welding, melting by way of any suitable heat source, and the like, without limitation.

As described hereinabove, in some instances conventional tamper evidence bands fail to detach from the closure upon being loosened, thereby making it difficult for an end-user to directly observe whether or not the closure has been previously separated from the container. In such instances, the end-user has little visual indication of whether the container has been reused. Embodiments disclosed herein below provide a tamper evidence closure that reliably provides a visible indication about whether or not a manufacturer-installed closure has been removed from a plastic container suitable for storing noncarbonated liquids, such as water or juice.

Figure 14:
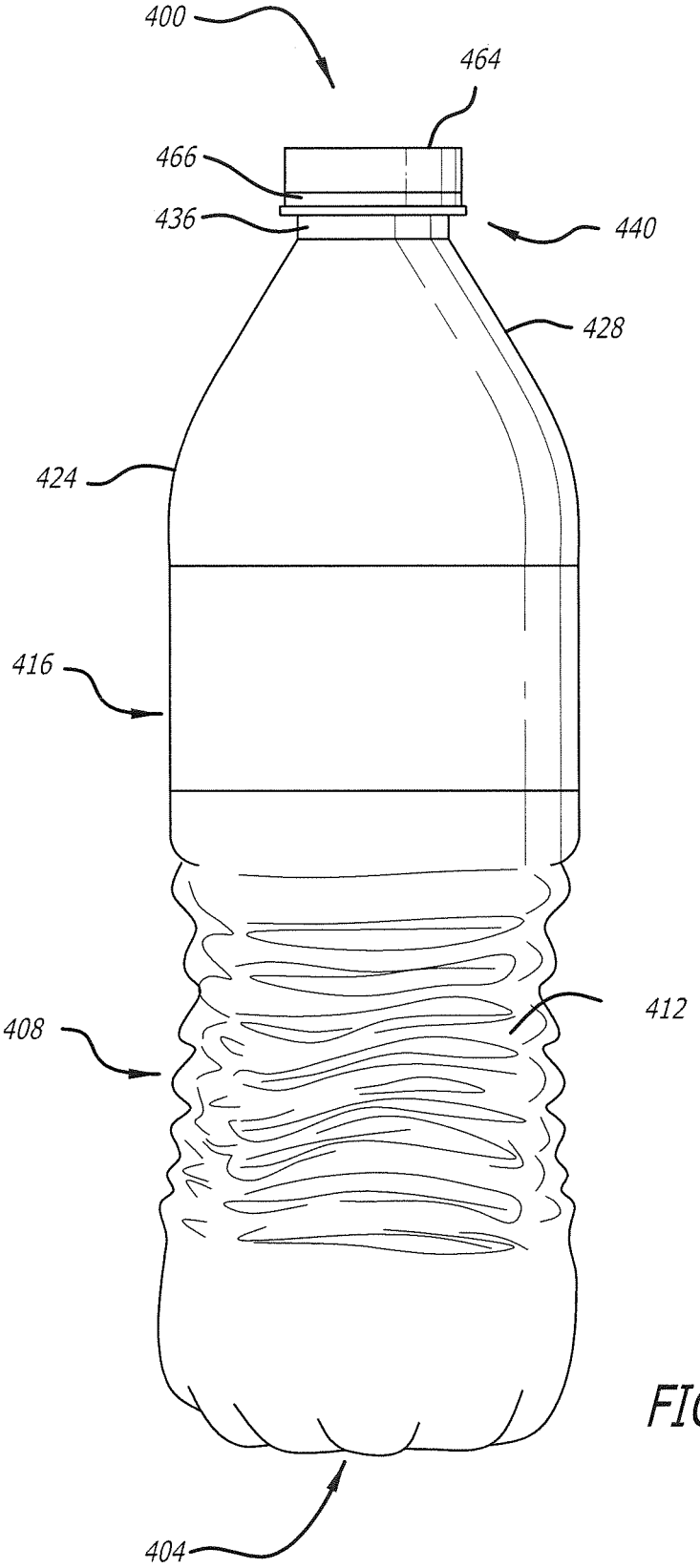
FIG. 14 illustrates a side view of an exemplary container suitable for storing a noncarbonated beverage, such as water or juice.

FIG. 14 illustrates a side view of an exemplary container 400 typically used for storing unpressurized liquid contents, such as water, juice, and the like. Similar to the container 100, the container 400 includes a base 404 that extends up to a grip portion 408. In some embodiments, the base 404 may be of a petaloid variety, although other configurations of the base 404 may be incorporated into the container 400, without limitation. The grip portion 408 comprises a plurality of grip portion ribs 412 (i.e., sidewall ribs). As illustrated in FIG. 14, the plurality of grip portion ribs 412 generally vary in depth, and swirl or angulate around the grip portion 408. A label portion 416 is connected to the grip portion 408 and comprises one or more label panel ribs (not shown). The label panel portion 416 transitions into a shoulder 424, which connects to a bell 428. The bell 428 connects to a neck 436, which connects to a finish 440. As shown in FIG. 14, the bell 428 comprises a diameter that generally decreases as the bell 428 extends upward from the shoulder 424 to the neck 436 and the finish 440. The finish 440 is adapted to receive a closure 464, such as a container cap or bottle cap, so as to seal contents within the container 400. The finish 440 generally defines an opening that leads to an interior of the container 400 for containing a beverage, such water, juice or other noncarbonated contents.

Figure 15:
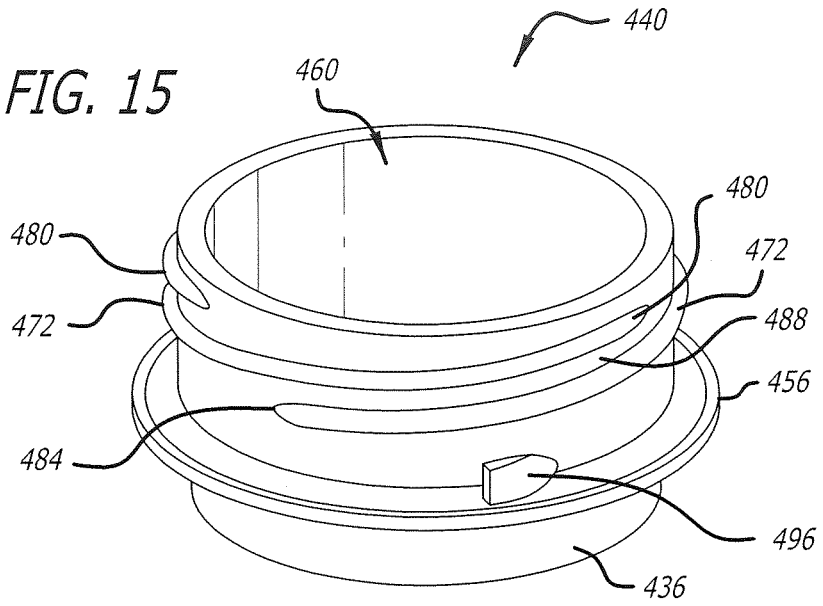
FIG. 15 illustrates an isometric view of an exemplary embodiment of a finish portion of a container configured to rotatably engage with a tamper evidence closure to seal contents within an interior of the container.

FIG. 15 illustrates an isometric view of an exemplary finish 440 that is configured to rotatably engage with the closure 464 so as to seal contents within the interior of the container 400. The finish 440 comprises a cylindrical body that begins at an opening 460 to an interior of the container 400 and extends to and includes a tamper evidence ledge 456. The finish 440 is further characterized by the presence of one or more threads 472 configured to provide a means to fasten the closure 464 to the container 400. As such, the threads 472 are configured to rotatably engage with similar threads disposed within the closure 464 to provide a way to seal contents within the container 400. In the embodiment illustrated in FIG. 15, each of the threads 472 generally extends along a section of the circumference of the finish 440 and approaches the tamper evidence ledge 456. Thus, when the threads of the closure 464 are engaged with the threads 472, and the closure 464 is rotated in a clockwise direction, the closure 464 advances toward the tamper evidence ledge 456.

In the embodiment illustrated in FIG. 15, each of the one or more threads 472 comprises a single thread 472 that begins at a thread start 480 and spirals around a section of the circumference of the finish 440 before terminating at a thread end 484. The thread start 480 is configured to guide a thread of the closure 464 into a space, or valley 488, between adjacent threads 472 so as to threadably engage the closure 464 with the finish 440. Further, the threads 472 generally are disposed adjacently to one another and are spaced uniformly around the circumference of the finish 440. As best shown in FIG. 15, at least one cam 496 is disposed adjacent to the tamper evidence ledge 456 and below the bottom-most threads 472. The cam 496 is configured to engage with a cam lock disposed in the closure 464 for the purpose of indicating whether or not the closure has been loosened after being installed by a manufacturer, as discussed herein.

Figure 16:
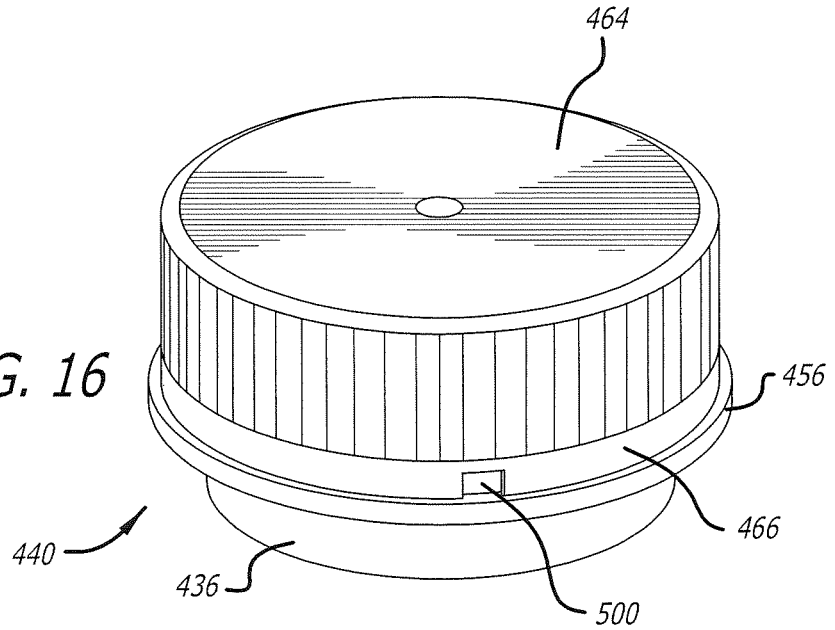
FIG. 16 illustrates an isometric view of a temper evidence closure that is threadably engaged with the finish shown in FIG. 15.

FIG. 16 illustrates an isometric view of a closure 464 that is threadably engaged with the finish 440 shown in FIG. 15. As mentioned hereinabove, the closure 464 includes interior threads that are configured to engage with the threads 472 of the finish 440. As such, the threads of the finish 440 extend into the thread valleys 488 disposed around the finish 440. During tightening of the closure 464 onto the finish 440, a plug seal of the closure 464 is configured to extend into the opening 460 and enter into a pressed relationship with the finish 440 whereby contents are sealed in the interior of the container 400.

Figure 17:
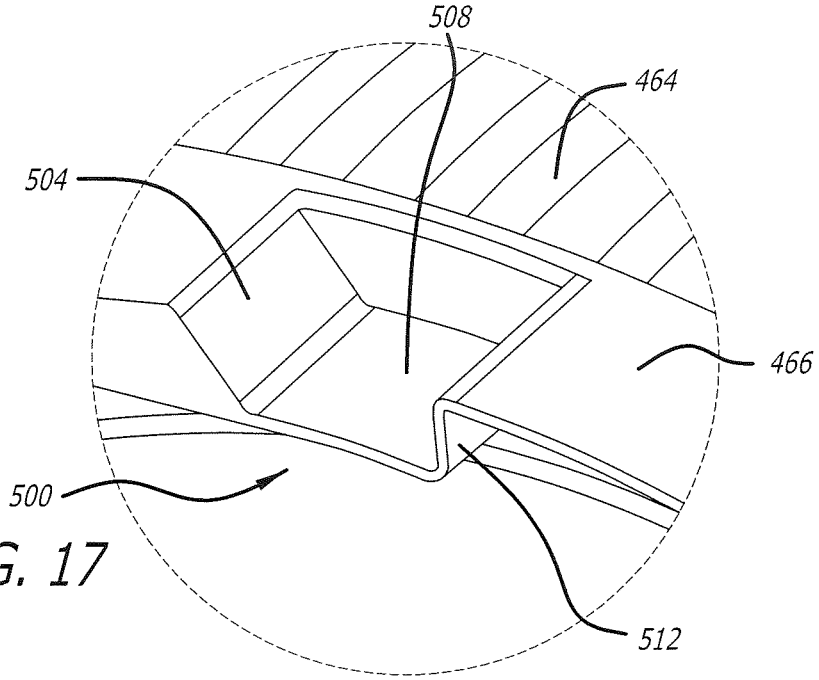
FIG. 17 illustrates a closeup view of a cam lock of a tamper evidence closure that is configured to engage with a cam disposed on a tamper evidence finish of a container.
Figure 18:
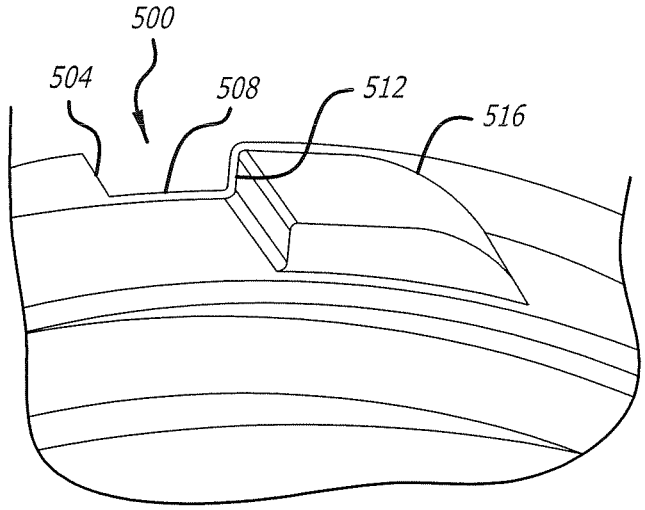
FIG. 18 illustrates a lower view of the cam lock of FIG. 17, showing a recess disposed within a tamper evidence portion of the closure.

As further shown in FIG. 16, the closure 464 includes a tamper evidence portion 466 that is disposed around the perimeter of a lower portion of the closure 464. The tamper evidence portion 466 includes a cam lock 500 configured to interfere with the cam 496 disposed on the finish 440. As best shown in FIG. 17, the cam lock 500 includes a ramped surface 504 that comprises a decreasing thickness of the tamper evidence portion 466 and terminates at a flat surface 508. The flat surface 508 comprises a relatively thin portion of the tamper evidence portion 466 that extends from the ramped surface 504 to a blunt surface 512, as best shown in FIG. 18. The blunt surface 512 is, in some embodiments, substantially perpendicular to the flat surface 508 and configured to interfere with the cam 496 during loosening of the closure 464 on the finish 440. As further shown in FIG. 18, a recess 516 is disposed in an interior of the closure 464 and configured to receive the cam 496 once the closure 464 is installed onto the finish 440 by the manufacturer.

Figure 19:
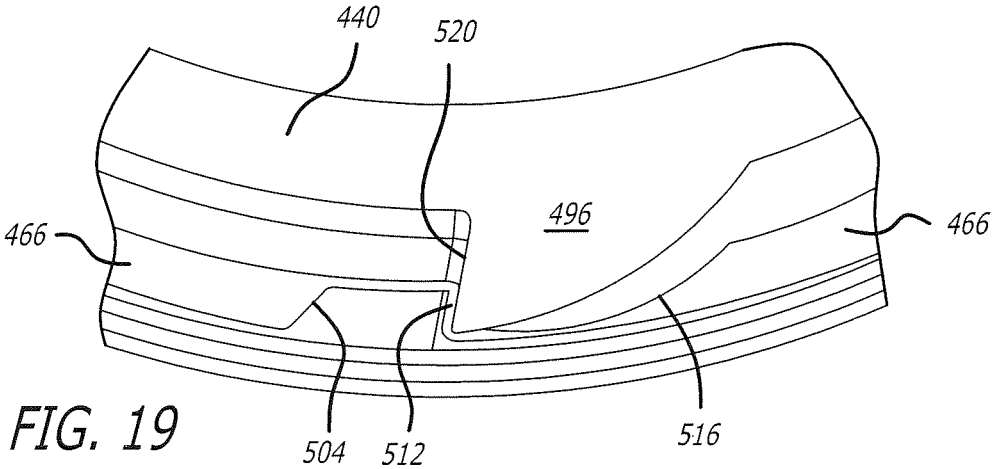
FIG. 19 illustrates a cross-sectional closeup view of an exemplary embodiment of a cam residing within the recess of FIG. 18.

FIG. 19 illustrates a cross-sectional closeup view of the cam 496 of the finish 440 positioned within the recess 516 of the tamper evidence portion 466 of the closure 464. The recess 516 generally enables the cam 496 to reside under the tamper evidence portion 466 without causing a bulge or otherwise pushing outwards on the tamper evidence portion 466. In the illustrated embodiment, the cam 496 comprises a sawtooth cross-sectional shape with a catching surface 520 disposed adjacent to the blunt surface 512 of the cam lock 500. The catching surface 520 is oriented at an angle that generally aligns with the angle of the blunt surface 512. In some embodiments, the angle of the surfaces 512, 520 is substantially perpendicular to the surface of the finish 440, as described hereinabove. In some embodiments, however, the angle of the surfaces 512, 520 may be greater than or lesser than perpendicular, without limitation.

As mentioned above, the blunt surface 512 is configured to interfere with the cam 496 when the closure 464 is loosened on the finish 440. For example, when an end-user turns the closure 464 counterclockwise on the finish 440 to loosen the closure, the blunt surface 512 moves into contact with the catching surface 520 of the cam 496. As the end-user continues twisting the closure 464, the blunt surface 512 forcibly contacts the catching surface 520 and drives the cam 496 against the blunt surface 512 and the flat surface 500. The flat surface 500 and the blunt surface 512 are configured to be pushed, or flared, outward when acted on by the catching surface 520 of the cam 496. It is contemplated that an outwardly flared cam lock 500 provides the end-user with a visual indication that the closure 464 has been loosened after being installed by the manufacturer.

It is contemplated that the number of cam locks 500 included in the tamper evidence portion 466 generally is equal to the number of cams 496 disposed on the finish 440. In some embodiments, for example, the finish 440 includes three cams 496 uniformly spaced around the circumference of the finish 440, and the tamper evidence portion 466 includes three cam locks 500 that are uniformly spaced around the circumference of the closure 464. The cam locks 500 preferably are positioned around the tamper evidence portion 466 such that the three cams 496 are all positioned within recesses 516 when the closure 464 is installed onto the finish 440 by the manufacturer. Thus, upon an end-user turning the closure 464 the cam locks 500 engage the three cams 496, thereby flaring the three cam locks 500 with respect to the closure 464, as described above. Further, once the cam locks 500 are initially flared, such as by the end-user loosening the closure 464, the cam locks 500 remain flared in absence of contacting the cams 496. As such, flared cam locks 500 indicate to the end-user that the closure 464 has been loosened after being installed by the manufacturer.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A tamper evidence assembly comprising:

a finish including a cylindrical body having an opening, one or more threads extending at least partially around a circumference of the cylindrical body;

and a closure including a generally cylindrical wall with interior threads configured to engage with the one or more threads, the wall further terminating in an edge, wherein the edge is ultrasonic welded to the finish.

2. The tamper evidence assembly of claim 1, further including a plurality of bridges positioned between the edge and the finish, and wherein the edge being ultrasonic welded to the finish means each bridge of the plurality of bridges is ultrasonic welded to the edge and to the finish.

3. The tamper evidence assembly of claim 1, wherein the edge is ultrasonic welded to the finish at spaced intervals.

4. The tamper evidence assembly of claim 3, wherein the spaced intervals are uniform spaced intervals.

* * * * *